US010039365B2

(12) United States Patent
Kuo

(10) Patent No.: US 10,039,365 B2
(45) Date of Patent: Aug. 7, 2018

(54) LIPSTICK CASE

(71) Applicant: Chen-Hui Kuo, Changhua (TW)

(72) Inventor: Chen-Hui Kuo, Changhua (TW)

(73) Assignee: Lo Mei Cosmetics Enterprise Co. Ltd., Changhua (TW)

( * ) Notice: Subject to any disclaimer, the term of this patent is extended or adjusted under 35 U.S.C. 154(b) by 0 days.

(21) Appl. No.: 15/201,867

(22) Filed: Jul. 5, 2016

(65) Prior Publication Data

US 2018/0008026 A1 Jan. 11, 2018

(51) Int. Cl.
*A45D 40/06* (2006.01)

(52) U.S. Cl.
CPC ..... *A45D 40/065* (2013.01); *A45D 40/06* (2013.01)

(58) Field of Classification Search
CPC combination set(s) only.
See application file for complete search history.

(56) References Cited

U.S. PATENT DOCUMENTS 6,497,524 B1 * 12/2002 Kim ..... A45D 40/205 401/107
8,657,514 B2 * 2/2014 Kim ..... A45D 40/205 401/107

* cited by examiner

*Primary Examiner* — David Walczak
(74) *Attorney, Agent, or Firm* — Che-Yang Chen; Law Offices of Scott Warmuth

(57) ABSTRACT

A lipstick case may comprise an outer tube, a control unit, an axle tube, a pushing rod, a guiding tube and an inner tube. A housing space is formed inside the outer tube, and a lid is connected at a rear end of the outer tube after the components such as the control unit, axle tube, etc. are received inside the housing space. Also, the lid is engaged with the control unit, so that the pushing or pulling force can be solidly transferred from the outer tube through the lid to the control unit. The present invention is preferable that a user can control a lipstick core of the lipstick case to stick out or receive in the inner tube by simply pushing or pulling action. Also, a user has no need to worry about losing the lid of the lipstick case thereby improving the practicality.

9 Claims, 7 Drawing Sheets

LIPSTICK CASE

FIELD OF THE INVENTION

The present invention relates to a lipstick case, and more particularly to a lipstick case configured to be operated by a simple pushing or pulling action.

BACKGROUND OF THE INVENTION

Generally, referring to FIG. 9, a conventional lipstick (70) comprises a shell (71), a rotary tube (72), a lipstick core (73) and a lid (74). A housing space (711) formed inside the shell (71) is configured to receive the rotary tube (72), and a spiral groove is formed at an inner wall of the housing space (711) such that the rotary tube (72) can rotate relative to the shell (71) to control the lipstick core (73) to expose out or to receive in the shell (71). An outer wall of the shell (71) near an opening of the housing space (711) has a plurality of locating pieces (712) which are configured to limit a position of the lid (74) when the lid (74) covers on an upper part of the lipstick (70).

However, the conventional lipstick has following disadvantages: a user needs to take off the lid (74) and rotates the rotary tube (72) to expose out the lipstick core (73) before the lipstick (70) is used which is convenient. Also, when the lid (74) is removed, it may be easily lost. Therefore, there remains a need for a new and improved design for a lipstick case to overcome the problems presented above.

SUMMARY OF THE INVENTION

The present invention provides a lipstick case which comprises an outer tube, a control unit, an axle tube, a pushing rod, a guiding tube and an inner tube. A housing space is formed inside the outer tube, and a lid is connected at a rear end of the outer tube after the components such as the control unit, axle tube, etc. are received inside the housing space. Also, the lid is engaged with the control unit, so that the pushing or pulling force can be solidly transferred from the outer tube through the lid to the control unit. The control unit comprises a fixed segment which is configured to connect to the lid after the control unit is received in the housing space. A first through hole penetrates through a central portion of the fixed segment, and a first spiral groove is formed inside the first through hole. Two elastic connecting pieces protrude from two opposing edges of a front end of the fixed segment and stick out from a front end of the outer tube, and two blocking pieces respectively protrude from two front ends of the connecting pieces. The axle tube comprises a second spiral groove formed inside thereof, and at least two first protruding pieces are formed at an outer periphery of a rear end of the axle tube. By engaging the first protruding pieces with the first spiral groove, the axle tube is configured to be coupled with the first through hole of the control unit. A rear portion of the pushing rod has at least two second protruding pieces which is configured to engage with the second spiral groove, and a front portion of the pushing rod has two fins protruding from two opposing lateral sides thereof. Also, a lipstick core is secured at a front end of the pushing rod. The guiding tube comprises a first main body and a second main body which connects a rear end of the first main body, and a second through hole penetrates through both central portions of the first main body and the second main body. Two guiding grooves are respectively formed at two relative positions on an inner wall of the second through hole, and two planes are respectively formed at a top portion and a bottom portion of the first main body such that two stepped edges are respectively formed between the second main body and the top portion of the first main body and between the second main body and the bottom portion of the first main body. Also, two lateral grooves are respectively extended from two stepped edges toward a rear end of the second main body such that the second main body is configured to extend outwardly when being pressed and to rebound back when being released. Moreover, the pushing rod is received in the guiding tube through the second through hole such that a front end of the axle tube is received in and connected to the second main body. By aligning the guiding grooves with the fins of the pushing rod, the pushing rod is configured to only be moved along the guiding grooves in the guiding tube instead of being rotated with the axle tube. The two connecting pieces of the control unit are respectively coupled in the two lateral grooves, and are respectively extended toward the planes. The inner tube comprises a front opening and a rear opening, and a front portion of the inner tube has a tapered segment such that a diameter of the rear opening is larger than the front opening. Also, the rear opening is configured to receive and secure the guiding tube, and a rear portion of the inner tube is received in the outer tube. As a result, when the lipstick case is not used, namely, the pushing rod is in a retracted position, and the tapered segment is configured to bear the two blocking pieces against each other thereby blocking the front opening of the inner tube.

Comparing with conventional lipstick case, the present invention is advantageous because: it is convenient that a user can control the lipstick core to stick out or receive in the inner tube by simply pushing or pulling action. Also, a user has no need to worry about losing the lid of the lipstick case thereby improving the practicality.

DETAILED DESCRIPTION OF THE INVENTION

Figure 1:
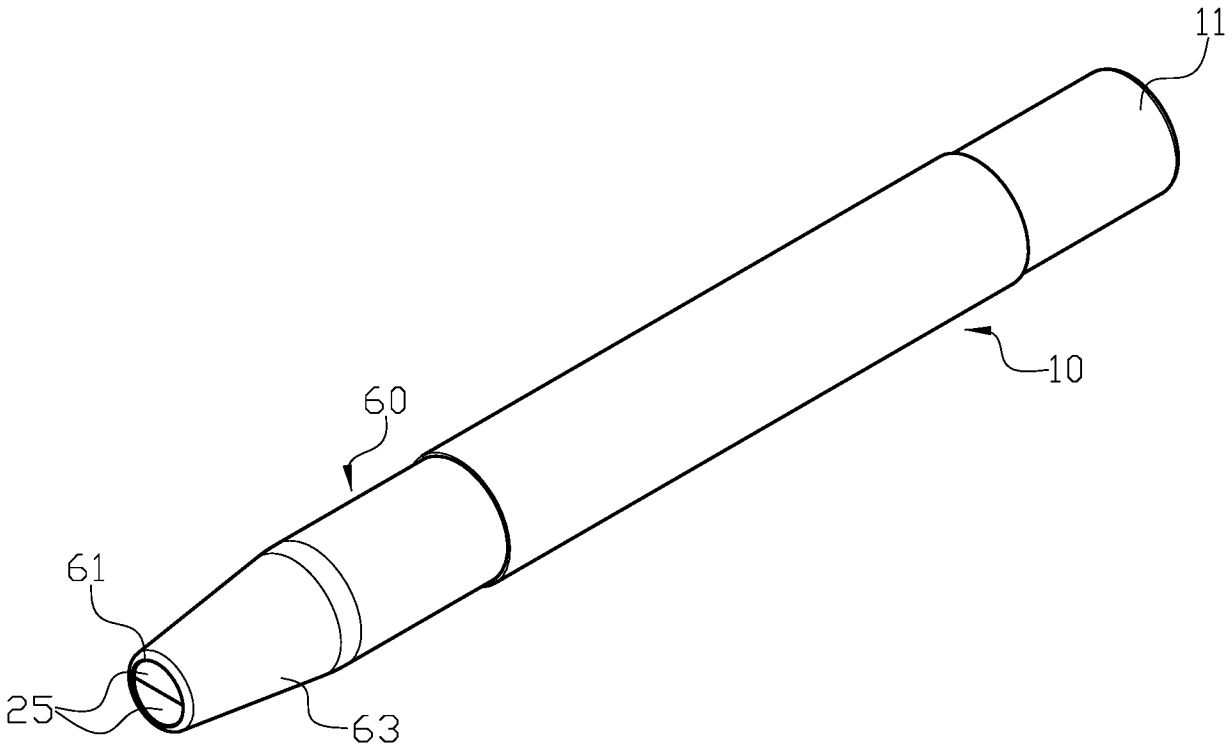
FIG. 1 is a three-dimensional assembly view of a lipstick case in the present invention.
Figure 2:
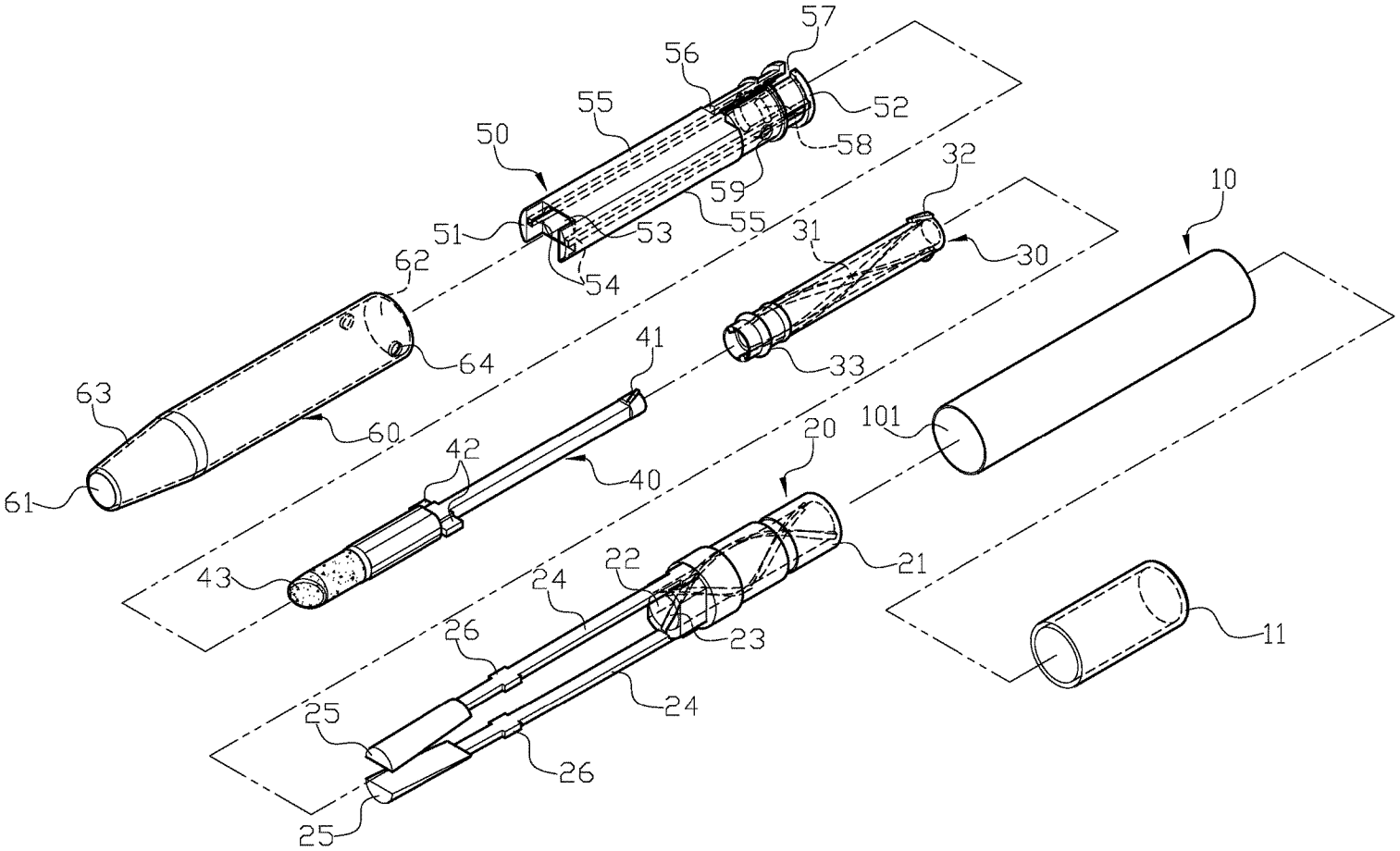
FIG. 2 is a three-dimensional exploded view of the lipstick case in the present invention.
Figure 3:
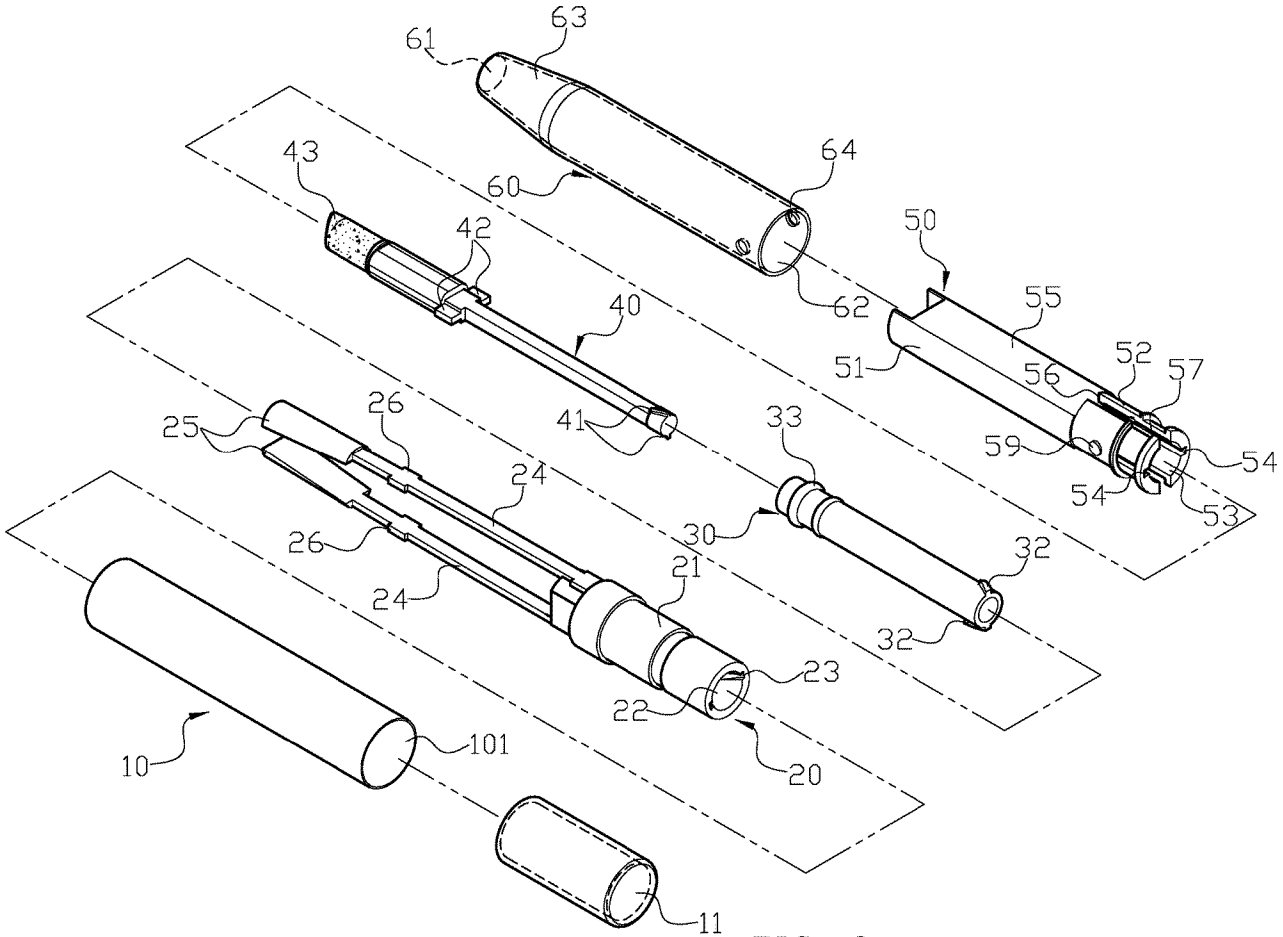
FIG. 3 is a three-dimensional exploded view from another angle of the lipstick case in the present invention.
Figure 4:
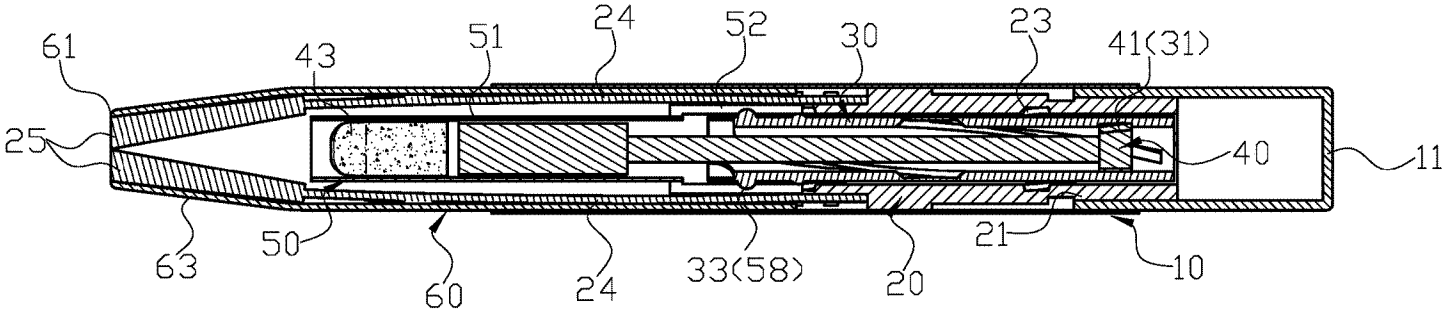
FIG. 4 is a sectional view illustrating a lipstick core of the lipstick case in the present invention is in a retracted position.
Figure 5:
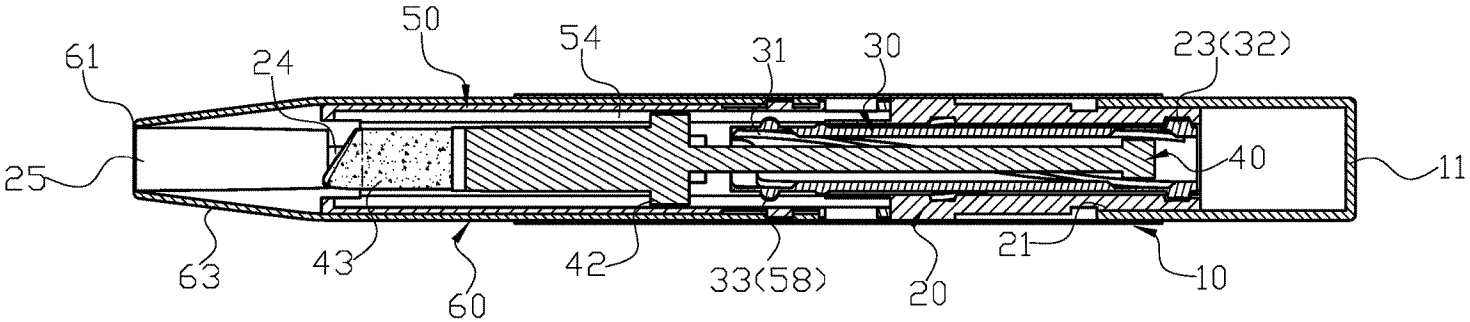
FIG. 5 is a sectional view from another angle illustrating the lipstick core of the lipstick case in the present invention is in the retracted position.

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

In order to further understand the goal, characteristics and effect of the present invention, a number of embodiments along with the drawings are illustrated as following:

Referring to FIGS. 1 to 5, the present invention provides a lipstick case which comprises an outer tube (10), a control unit (20), an axle tube (30), a pushing rod (40), a guiding tube (50) and an inner tube (60). A housing space (101) is formed inside the outer tube (10), and a lid (11) is connected at a rear end of the outer tube (10) after the components such as the control unit (20), axle tube (30), etc. are received inside the housing space (101). Also, the lid (11) is engaged with the control unit (20), so that the pushing or pulling force can be solidly transferred from the outer tube (10) through the lid (11) to the control unit (20). The control unit (20) comprises a fixed segment (21) which is configured to connect to the lid (11) after the control unit (20) is received in the housing space (101). A first through hole (22) penetrates through a central portion of the fixed segment (21), and a first spiral groove (23) is formed inside the first through hole (22). Two elastic connecting pieces (24) protrude from two opposing edges of a front end of the fixed segment (21) and stick out from a front end of the outer tube (10), and two blocking pieces (25) respectively protrude from two front ends of the connecting pieces (24). The axle tube (30) comprises a second spiral groove (31) formed inside thereof, and at least two first protruding pieces (32) are formed at an outer periphery of a rear end of the axle tube (30). By engaging the first protruding pieces (32) with the first spiral groove (23), the axle tube (30) is configured to be coupled with the first through hole (22) of the control unit (20). A rear portion of the pushing rod (40) has at least two second protruding pieces (41) which is configured to engage with the second spiral groove (31), and a front portion of the pushing rod (40) has two fins (42) protruding from two opposing lateral sides thereof. Also, a lipstick core (43) is secured at a front end of the pushing rod (40). The guiding tube (50) comprises a first main body (51) and a second main body (52) which connects a rear end of the first main body (51), and a second through hole (53) penetrates through both central portions of the first main body (51) and the second main body (52). Two guiding grooves (54) are respectively formed at two relative positions on an inner wall of the second through hole (53), and two planes (55) are respectively formed at a top portion and a bottom portion of the first main body (51) such that two stepped edges (56) are respectively formed between the second main body (52) and the top portion of the first main body (51) and between the second main body (52) and the bottom portion of the first main body (51). Also, two lateral grooves (57) are respectively extended from two stepped edges toward a rear end of the second main body (52) such that the second main body (52) is configured to extend outwardly when being pressed and to rebound back when being released. Moreover, the pushing rod (40) is received in the guiding tube (50) through the second through hole (53) such that a front end of the axle tube (30) is received in and connected to the second main body (52). By aligning the guiding grooves (54) with the fins (42) of the pushing rod (40), the pushing rod (40) is configured to only be moved along the guiding grooves (54) in the guiding tube (50) instead of being rotated with the axle tube (30). The two connecting pieces (24) of the control unit (20) are respectively coupled in the two lateral grooves (57), and are respectively extended toward the planes (55). The inner tube (60) comprises a front opening (61) and a rear opening (62), and a front portion of the inner tube (60) has a tapered segment (63) such that a diameter of the rear opening (62) is larger than the front opening (61). Also, the rear opening (62) is configured to receive and secure the guiding tube (50), and a rear portion of the inner tube (60) is received in the outer tube (10). As a result, when the lipstick case is not used, namely, the pushing rod (40) is in a retracted position, and the tapered segment (63) is configured to bear the two blocking pieces (25) against each other thereby blocking the front opening (61) of the inner tube (60).

Figure 6:
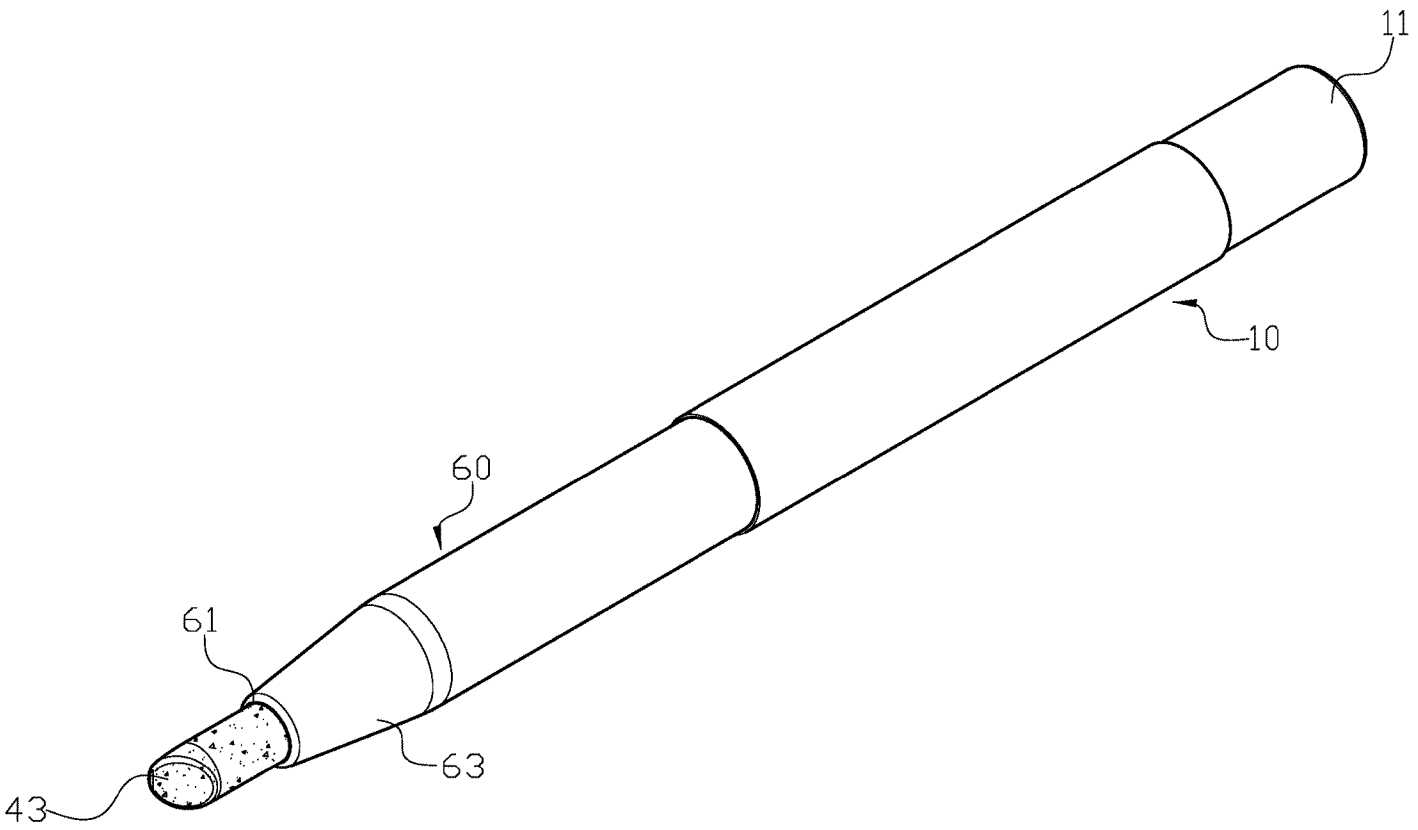
FIG. 6 is a three-dimensional view illustrating the lipstick core of the lipstick case in the present invention is in an exposed position.
Figure 7:
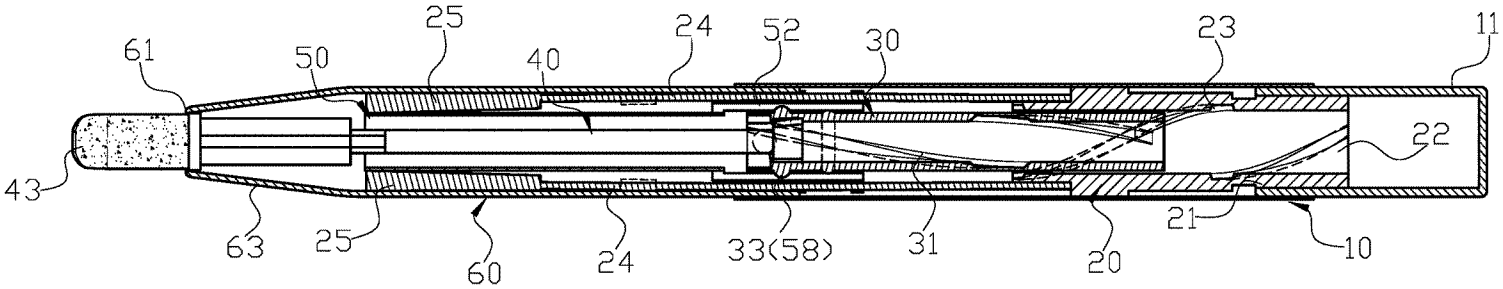
FIG. 7 is a sectional view illustrating the lipstick core of the lipstick case in the present invention is in the exposed position.
Figure 8:
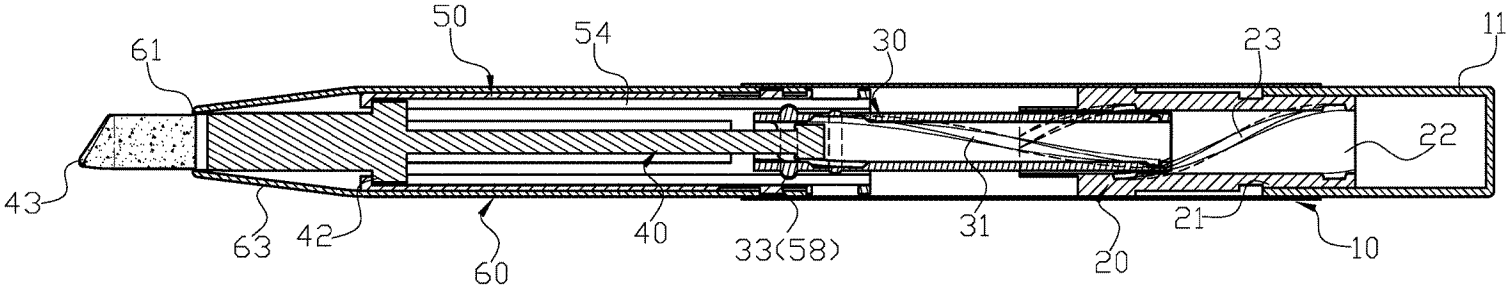
FIG. 8 is a sectional view from another angle illustrating the lipstick core of the lipstick case in the present invention is in the exposed position.
Figure 9:
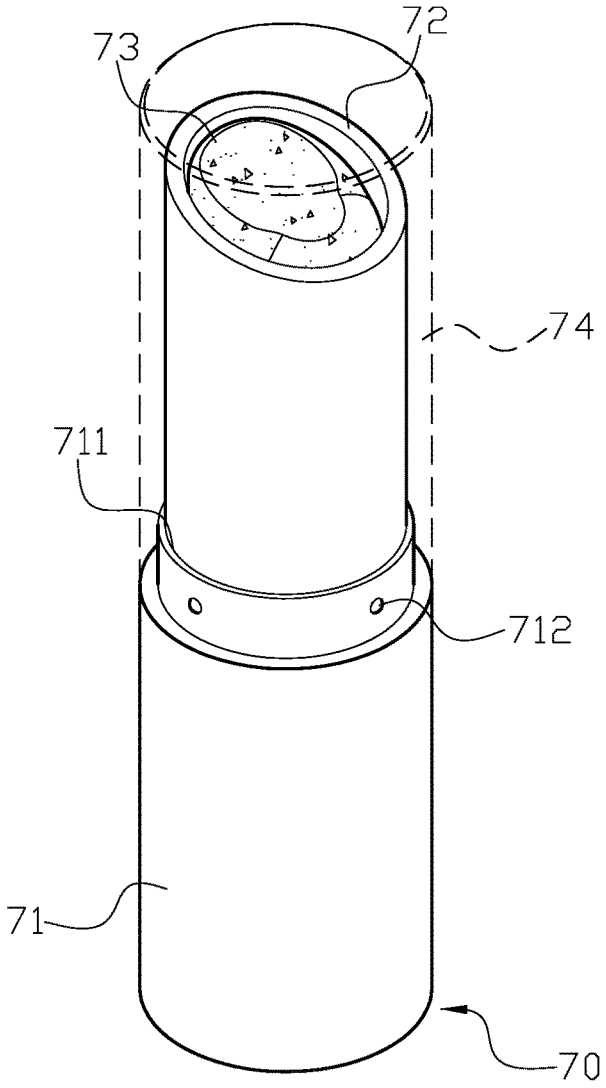
FIG. 9 PRIOR ART
FIG. 9 is a prior art.

Referring to FIGS. 6 to 8, in actual application, to paint a user's lips with the lipstick case of the present invention, the outer tube (10) and the inner tube (60) are pulled in opposing directions. By engaging the first spiral groove (23) with the first protruding pieces (32), in pulling process, the axle tube (30) driven by first protruding pieces (32) is rotated to drive the second protruding pieces (41) of the pushing rod (40) to move along the second spiral groove (31) such that the lipstick core (43) on the pushing rod (40) is configured to gradually protrude from a front end of the guiding tube (50). Also, by pulling the outer tube (10) and the inner tube (60) in the opposing directions, the axle tube (30) is rotated to drive the pushing rod (40) to move toward the front end (61) of the inner tube (60) thereby driving the control unit (20) and the guiding tube (50) to move away from each other. Moreover, the blocking pieces (25) driven by the connecting pieces (24) are detached from the tapered segment (63), and since two inner faces of the blocking pieces (25) are borne against the guiding tube (50), the two blocking pieces are separated from each other to respectively couple on the two planes (55). Meanwhile, the front opening (61) of the inner tube (60) is not blocked by the blocking pieces (25) such that the lipstick core (43) is configured to protrude from the front opening (61) thereby painting a user's lips. On the other hand, when the outer tube (10) and the inner tube (60) are pushed to move toward each other, the lipstick core (43) is moved back into the guiding tube (50) thus preventing the lipstick core (43) from being contaminated or being broken.

In one embodiment, the lid (11) is glued on the fixed segment (21) of the control unit (20).

In another embodiment, a diameter of the outer tube (10) is larger than the lid (11) such that the lid (11) is configured to be received and firmly glued on a rear portion of the outer tube (10).

In still another embodiment, each of the two connecting pieces (24) of the control unit (20) further has a blocking segment (26) protruding from two lateral sides thereof, and the blocking segments (26) are configured to limit and determine the maximum relative shifting distance between the control unit (20) and the guiding tube (50) when the stepped edges (56) of guiding tube (50) are borne against the blocking segments (26).

In a further embodiment, a flange (33) is formed at a front portion of the axle tube (30), and an annular groove (58) is formed inside the second main body (52) of the guiding tube (50). By coupling the flange (33) in the annular groove (58), the axle tube (30) is firmly connected with the second main body (52) of the guiding tube (50).

In still a further embodiment, the lipstick core (43) of the pushing rod (40) is a lipstick.

In yet a further embodiment, the lipstick core (43) of the pushing rod (40) is a lip balm.

In a particular embodiment, a front end of the guiding grooves (54) are blocked, and a rear portion thereof penetrates through two lateral sides of the second main body (52).

In a preferred embodiment, at least two locating holes (64) located near the rear opening (62) respectively penetrate two sides of a lateral wall of the inner tube (60), and at least two locating pieces (59) protruding from an outer surface of the second main body (52) of the guiding tube (50) are configured to engage with the locating holes (64) thus securing the guiding tube (50) in the inner tube (60).

Comparing with conventional lipstick, the present invention is advantageous because: it is convenient that a user can control the lipstick core (43) to stick out or receive in the inner tube (60) by simply pushing or pulling action. Also, a user has no need to worry about losing the lid of the lipstick case thereby improving the practicality.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A lipstick case comprising:

an outer tube having a housing space formed inside thereof, and a lid connected at a rear end of the outer tube;

a control unit engaging with the lid comprising a fixed segment which is configured to connect to the lid after the control unit is received in the housing space, and a first through hole penetrating through a central portion of the fixed segment, and a first spiral groove formed inside the first through hole, two elastic connecting pieces protruding from two opposing edges of a front end of the fixed segment and sticking out from a front end of the outer tube, and two blocking pieces respectively protruding from two front ends of the connecting pieces;

an axle tube comprising a second spiral groove which is formed inside thereof, and at least two first protruding pieces formed at an outer periphery of a rear end of the axle tube, by engaging the first protruding pieces with the first spiral groove of the control unit, the axle tube configured to be coupled with the first through hole of the control unit;

a pushing rod having at least two second protruding pieces formed at a rear portion thereof and configured to engage with the second spiral groove of the axle tube, and a front portion of the pushing rod having two fins respectively protruding from two opposing lateral sides thereof, a lipstick core secured at a front end of the pushing rod;

a guiding tube comprising a first main body and a second main body, and a second through hole penetrating through both central portions of the first main body and the second main body, two guiding grooves respectively formed at two relative positions on an inner wall of the second through hole, and two planes respectively formed at a top portion and a bottom portion of the first main body such that two stepped edges respectively formed between the second main body and each of the two planes, two lateral grooves respectively extended from two stepped edges toward a rear end of the second main body such that the second main body configured to extend outwardly when being pressed and to rebound back when being released, and the pushing rod received in the guiding tube through the second through hole such that a front end of the axle tube received in and connected to the second main body, by aligning the guiding grooves with the fins of the pushing rod, the pushing rod configured to only be moved along the guiding grooves in the guiding tube instead of being rotated with the axle tube, the two connecting pieces of the control unit respectively coupled in the two lateral grooves and respectively extended toward the planes; and an inner tube comprising a front opening and a rear opening, and a front portion of the inner tube having a tapered segment such that a diameter of the rear opening being larger than the front opening, and the rear opening configured to receive and secure the guiding tube, and a rear portion of the inner tube received in the outer tube, when the lipstick case being not used, the pushing rod being in a retracted position, and the tapered segment configured to bear the two blocking pieces against each other thereby blocking the front opening of the inner tube.

2. The lipstick case of claim 1, wherein the lid is glued on the fixed segment of the control unit.

3. The lipstick case of claim 1, wherein a diameter of the outer tube is larger than the lid such that the lid is configured to be received and firmly glued on a rear portion of the outer tube.

4. The lipstick case of claim 1, wherein each of the two connecting pieces of the control unit further has a blocking segment protruding from two lateral sides thereof.

5. The lipstick case of claim 1, wherein a flange is formed at a front portion of the axle tube, and an annular groove formed inside the second main body of the guiding tube is configured to receive and couple with the flange such that the axle tube is firmly connected with the second main body of the guiding tube.

6. The lipstick case of claim 1, wherein the lipstick core of the pushing rod is a lipstick.

7. The lipstick case of claim 1, wherein the lipstick core of the pushing rod is a lip balm.

8. The lipstick case of claim 1, wherein a front end of the guiding groove is blocked, and a rear portion thereof penetrates through two lateral sides of the second main body.

9. The lipstick case of claim 1, wherein at least two locating holes located near the rear opening respectively penetrate two sides of a lateral wall of the inner tube, and at least two locating pieces protruding from an outer surface of the second main body of the guiding tube are configured to engage with the locating holes thus securing the guiding tube in the inner tube.

* * * * *